US007556534B1

(12) United States Patent
Ho

(10) Patent No.: US 7,556,534 B1
(45) Date of Patent: Jul. 7, 2009

(54) DUAL-CARD CONNECTOR

(75) Inventor: Hsing-Tsung Ho, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/176,146

(22) Filed: Jul. 18, 2008

(51) Int. Cl.
*H01R 24/00* (2006.01)

(52) U.S. Cl. ..... 439/630; 439/540.1; 439/607

(58) Field of Classification Search ..... 439/630, 439/61, 607, 540.1, 541.5
See application file for complete search history.

(56) References Cited

U.S. PATENT DOCUMENTS 6,482,029 B2 * 11/2002 Nishimura ..... 439/541.5
6,776,653 B1 * 8/2004 Hsiao ..... 439/541.5
7,040,908 B2 * 5/2006 Kamata ..... 439/159
7,344,416 B2 * 3/2008 Quijin ..... 439/630
2008/0041952 A1 * 2/2008 Kang ..... 235/441

* cited by examiner

*Primary Examiner*—Hien Vu
(74) *Attorney, Agent, or Firm*—WPAT, PC; Anthony King

(57) ABSTRACT

A dual-card connector has an insulating housing. The insulating housing has a top surface which defines a first surface and a second surface, the second surface is lower than and adjoins the first surface. A plurality of first and second terminals is respectively mounted to the first and second surface. A shell assembled with the insulating housing has a first cover, a connecting portion extending downwards from an edge of the first cover, and a second cover extending opposite to the first cover from a lower portion of the connecting portion such that the second cover is lower than the first cover. The connecting portion is supported on a place of the first surface adjacent to the second surface; the first and the second cover are respectively disposed above the first and second surface to form a first insertion space and a second insertion space therebetween.

5 Claims, 4 Drawing Sheets

DUAL-CARD CONNECTOR

BACKGROUND OF THE INVENTION

1. Field of the Invention

The present invention relates to a dual-card connector, and more particularly to a dual-card connector with two isolated insertion spaces in a small volume thereof.

2. The Related Art

With development of electronic technology, the developing trend of electrical devices is toward multifunction and miniaturization. For example, a mobile phone is not only capable of wireless communication, but also offers shoot function, MP3, MP4 and so on, and consequently the mobile phone is required to have large memory space for storing photos and relative audio files. Normally, this large memory is provided by many kinds of memory cards for example a secure digital card (SD card) and in this case, a connector is needed to connect the card to the mobile phone. However, a connector used for receiving such SD card is independently mounted in the mobile phone, which occupies much space within the mobile phone. So a dual-card connector with two insertion spaces to receive a subscriber identity model (SIM) card and a SD card is a suitable one to meet current requirement.

However, one kind of conventional dual-card connectors which is capable of providing two different insertion spaces for receiving electronic cards of different size can not receive two cards at one time. Another kind of conventional dual-card connector with two insertion spaces can accommodate two electronic cards at one time, but the two electronic cards inserted therein will interfere with each other adversely electronically because the two-insertion spaces designed in a small volume are not isolated electromagnetically from each other completely. Hence, a dual-card connector with two isolated insertion spaces is required.

SUMMARY OF THE INVENTION

Accordingly, an object of the present invention is to provide a dual-card connector with two isolated insertion spaces in a small volume thereof.

A dual-card connector has an insulating housing. The insulating housing has a top surface which defines a first surface and a second surface, and the second surface is lower than and adjoins the first surface. A plurality of first and second terminals is respectively mounted to the first and second surface. A shell assembled with the insulating housing has a first cover, a connecting portion extending downwards from an edge of the first cover, and a second cover extending opposite to the first cover from a lower portion of the connecting portion such that the second cover is lower than the first cover. The connecting portion is supported on a place of the first surface adjacent to the second surface; the first and the second cover are respectively disposed above the first and second surface to form a first insertion space and a second insertion space therebetween.

As described above, the second surface is recessed downwards to be lower than the first surface, and the connecting portion is adapted to separate the first insertion space from the second insertion space to form two isolating insertion spaces. Thus, when two electronic cards are inserted into the dual-card connector, such structure of the dual-card connector will be able to obstruct the first insertion space and the second insertion space to avoid interference between the electronic cards.

BRIEF DESCRIPTION OF THE DRAWINGS

The present invention will be apparent to those skilled in the art by reading the following description of an embodiment thereof, with reference to the accompanying drawings, in which.

DETAILED DESCRIPTION OF THE EMBODIMENTS

Figure 1:
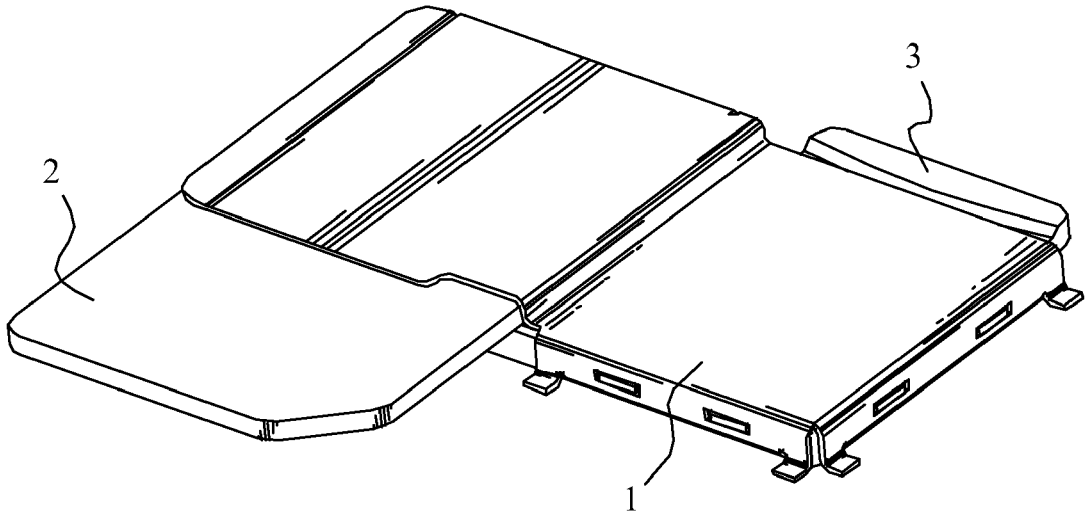
FIG. 1 is a perspective view of a dual-card connector of an embodiment according to the present invention, wherein a SIM and a SD card are assembled into the dual-card connector.
Figure 2:
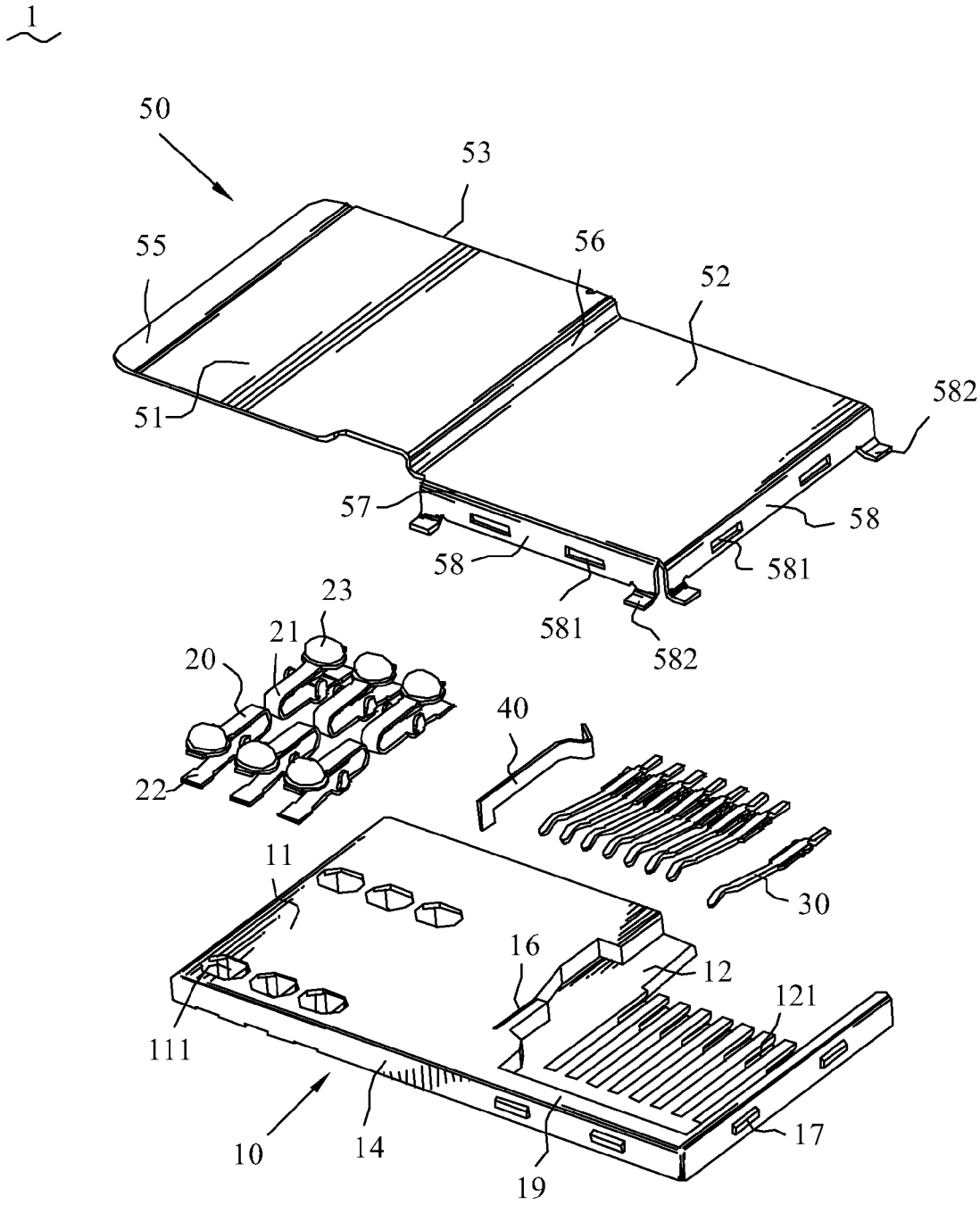
FIG. 2 is an exploded, perspective view of the dual-card connector shown in FIG. 1.

With reference to FIG. 1 and FIG. 2, an embodiment of a dual-card connector 1 according to the present invention is shown. The dual-card connector 1 includes an insulating housing 10, a plurality of first terminals 20 and second terminals 30, a resilient positioning component 40 and a shell 50.

Figure 3:
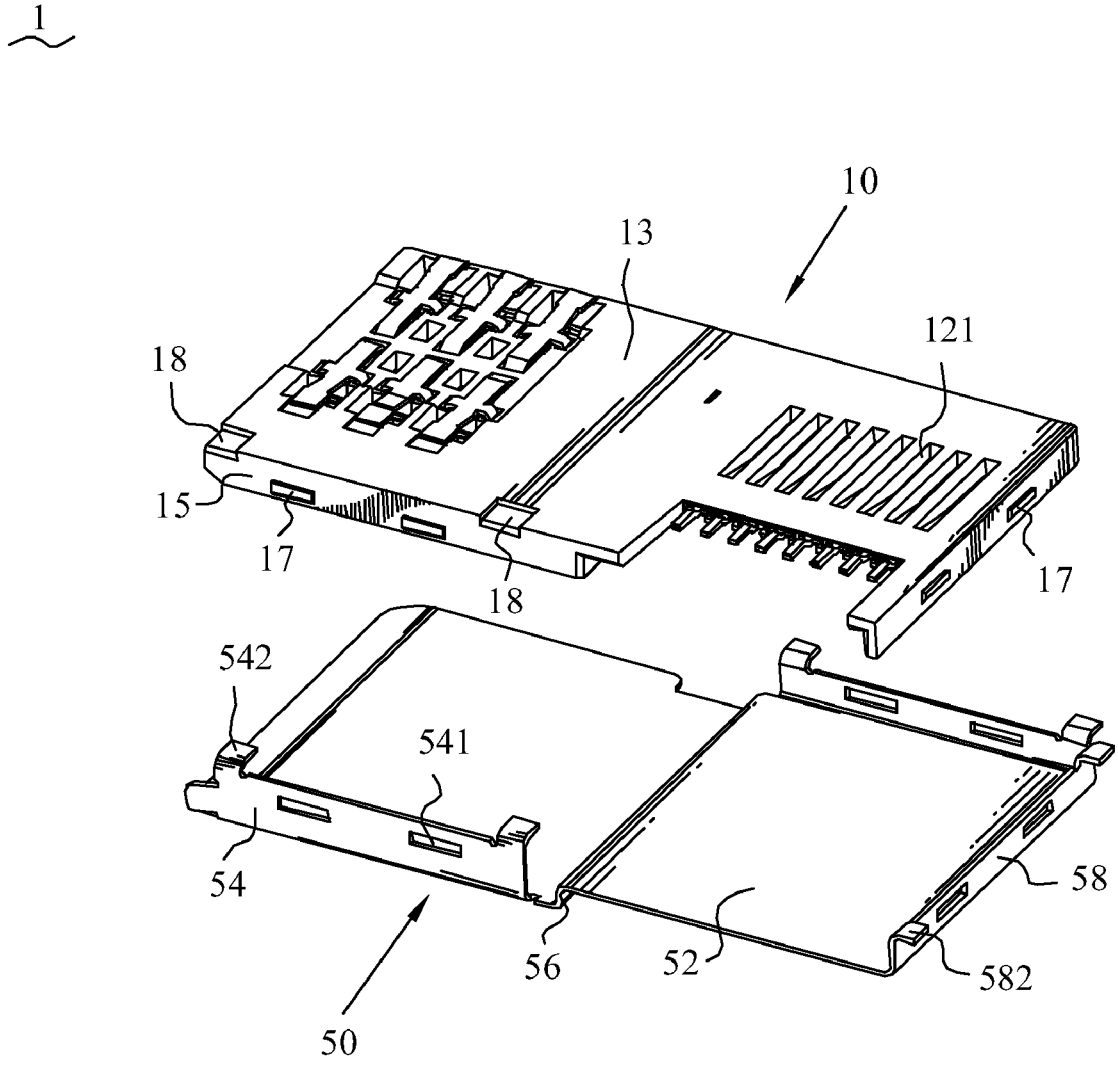
FIG. 3 is another exploded, perspective view of the dual-card connector shown in FIG. 1 seen from a bottom view, wherein a plurality of first terminals and a plurality of second terminals are received in an insulating housing.

Please refer to FIG. 2 and FIG. 3, the insulating housing 10 is substantially a rectangular-board shape and defines a first surface 11 at one side of a top surface 19 thereof, a second surface 12 at the other side of the top surface 19 thereof, a bottom surface 13, a front side 14 and a rear side 15. The first surface 11 is holed downwards to form a plurality of terminal receiving holes 111, each terminal receiving hole 111 passing through the whole insulating housing 10 in a direction traverse to the first surface 11 for receiving respective first terminal 20. The second surface 12 is recessed downwards with respect to the first surface 11 and passes through the rear side 15. The second surface 12 has a plurality of terminal recesses 121 arranged at certain intervals e.g. regular intervals for receiving the second terminals 30. A positioning cavity 16 is formed between the first surface 11 and the second surface 12 to receive the resilient positioning component 40. An end of the resilient positioning component 40 bends and then extends oppositely to show a V-shape for fixing an electronic card (not shown) received in the second surface 12. The front side 14 near the second surface 12, an end of the insulating housing 10 near the second surface 12 and a rear side 15 near the first surface 11 respectively protrude outwards to form two lumps 17. The bottom surface 13 has two buckling recesses 18 passing through the rear side 15.

The first terminal 20 may be formed by punching a metal plate and may define a substantially U-shaped bending arm 21. One end of the bending arm 21 inclines downwards and then extends horizontally to form a soldering portion 22. The soldering portion 22 is soldered to a printed circuit board (not shown). And the other end of the bending arm 21 extends upwardly to form a dome shaped contact portion 23.

Referring to FIG. 2 and FIG. 3, the shell 50 may be made by machining a metal sheet and defines a first cover 51 and a second cover 52. The first cover 51 is substantially a rectangular shape and defines a rear edge 53. The rear edge 53 extends downwards to form a first side plate 54. The first side plate 54 has two coupling holes 541 corresponding to the lumps 17. A bottom of the first side plate 54 extends inwards to form two buckling tabs 542 corresponding to buckling recesses 18. One edge of the first cover 51 adjacent to the rear edge 53 bends upwardly to form a bending portion 55 for facilitating easy insertion of an electronic card.

The other edge of the first cover 51 adjacent to the rear edge 53 extends downwardly to form a connecting portion 56. The second cover 52 extends opposite to the first cover 51 from a bottom of the connecting portion 56. The second cover 52 is rectangular and defines a front edge 57. The front edge 57 and an edge of the second cover 52 adjacent to the front edge 57 extend downwardly to form a second side plate 58 respectively. The second side plate 58 has two coupling holes 581 corresponding to the lumps 17. A bottom of the second side plate 58 extends outwards to form two soldering tabs 582 for fixing the dual-card connector 1 to an electrical device (not shown).

Figure 4:
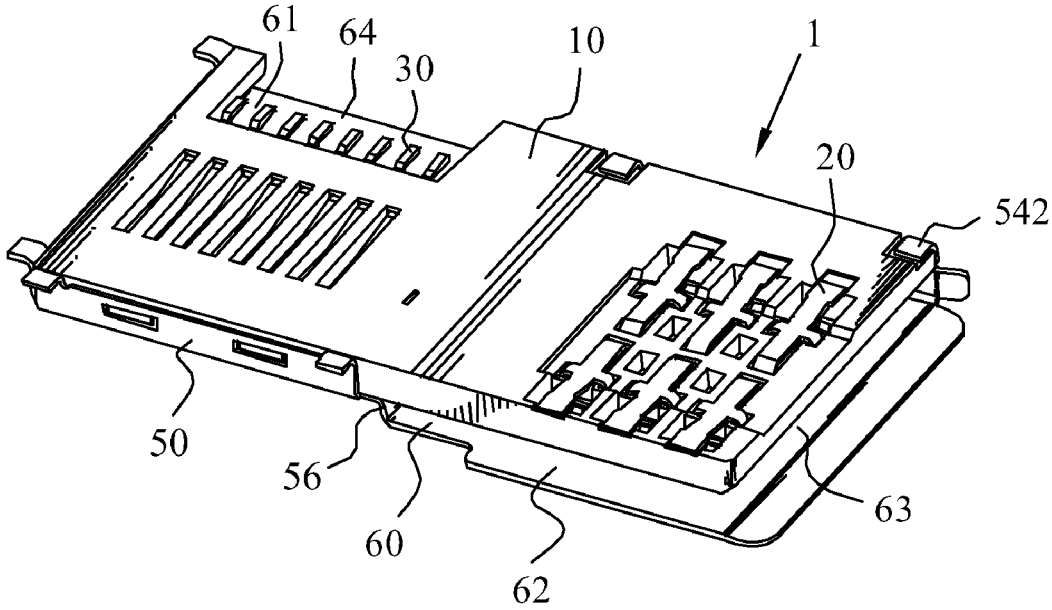
FIG. 4 is an assembled, perspective view of the dual-card connector shown in FIG. 2 seen from a front and bottom view.

Please refer to FIGS. 1-2 and FIG. 4, when the shell 50 couples together with the insulating housing 10, the coupling holes 541 and 581 are respectively mate with the corresponding lumps 17, the buckling tabs 542 respectively abut the corresponding buckling recesses 18. At this time, a first insertion space 60 used to receive a SIM card 2 and a second insertion space 61 used to receive a SD card 3 are respectively formed between the first surface 11 and the second surface 12 and the shell 50. Since the second surface 12 is lower than the first surface 11, and the first cover 51 is higher than the second cover 52, the first insertion space 60 is higher than the second insertion space 61. The connecting portion 56 is pressed against the first surface 11 and located between the first insertion space 60 and the second insertion space 61 so as to separate the first insertion space 60 from the second insertion space 61. Furthermore, the second cover 52 is partly against the top surface 19 around the second surface 12, which preferably obstructs the first insertion space 60 and the second insertion space 61 so as to reduce interference between the SIM card 2 and SD card 3.

In additional, the first cover 51 has two free edges contiguous to each other. So during assembly, a first insertion opening 62 and a second insertion opening 63 are respectively formed between the first cover 51 and the insulating housing 10. The bending portion 58 is adapted to guide the SIM card 2 into the first insertion space 60 conveniently. An edge of the second cover 52 opposite to the front edge 57 and the second surface 12 together form a third insertion opening 64, allowing the SD card 3 to insert into the second insertion space 61.

As described above, the dual-card type connector 1 has the first insertion space 60 and the second insertion space 61 isolated from each other, which prevents the SIM card 2 and the SD card 3 from being interfered by the other when the SIM card 2 and the SD card 3 are inserted at any time, thus guaranteeing performance of an electrical device with the dual-band connector 1 mounted therein. Moreover, the dual-band connector 1 with the first insertion opening 62 and the second insertion opening 63 is advantageous to be assembled to the electrical device flexiblely and adds the practicability of the dual-card connector 1.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A dual-card connector comprising: an insulating housing having a top surface which defines a first surface at one side thereof and a second surface which is lower than the first surface and the top surface, and located at the other side thereof and adjoins the first surface;

a plurality of first terminals mounted in a first section of the housing having the first surface;

a plurality of second terminals mounted in a second section of the housing having the second surface, and the second terminals having different shapes than the first terminals; and a conductive shell assembled with the insulating housing, the shell having a first cover, a connecting portion extending downwards from an edge of the first cover, and a second cover extending opposite to the first cover from a lower portion of the connecting portion such that the second cover is lower than the first cover, wherein the connecting portion is supported on a place of the first surface adjacent to the second surface, the first cover is disposed above and space from the first surface to form a first insertion space therebetween, while the second cover is supported by the top surface of the second section of the insulating housing and disposed above the second surface to form a second insertion space therebetween;

wherein the first cover has two free edges contiguous to each other, the first insertion space has a first insertion opening and a second insertion opening communicating with each other formed between the two free edges and the insulating housing.

2. The dual-card connector as claimed in claim 1, wherein an edge of the first cover different from the free edges and adjacent to the connecting portion extends downwards to form a first side plate with coupling holes therein for coupling with corresponding lumps protruding from a side of the insulating housing.

3. The dual-card connector as claimed in claim 2, wherein a bottom of the first side plate extends and bends inwards to form buckling tabs buckling a bottom of the insulating housing.

4. The dual-card connector as claimed in claim 1, wherein an edge of the second cover adjacent to the connecting portion and the second surface define a third insertion opening therebetween.

5. The dual-card connector as claimed in claim 4, wherein two adjacent edges of the second cover respectively opposite to the connecting portion and the third insertion opening extend downwards to form two second side plates with coupling holes therein for coupling with corresponding lumps protruding from two adjacent sides of the insulating housing.

* * * * *